US007171998B2

(12) United States Patent
Vogel

(10) Patent No.: US 7,171,998 B2
(45) Date of Patent: Feb. 6, 2007

(54) PROCESS FOR PRODUCING A STRUCTURED DECORATION IN A WOODBASED-MATERIAL BOARD

(75) Inventor: Hans Vogel, Ruswil (CH)

(73) Assignee: Kronotec AG, Luzern (CH)

( * ) Notice: Subject to any disclaimer, the term of this patent is extended or adjusted under 35 U.S.C. 154(b) by 223 days.

(21) Appl. No.: 10/697,559

(22) Filed: Oct. 31, 2003

(65) Prior Publication Data

US 2004/0250911 A1 Dec. 16, 2004

(30) Foreign Application Priority Data

Nov. 12, 2002 (DE) ..... 102 52 865

(51) Int. Cl.
*B27H 1/00* (2006.01)
*B27M 1/00* (2006.01)

(52) U.S. Cl. ..... 144/358; 144/4.8; 144/344

(58) Field of Classification Search ..... 144/344, 144/329, 346, 358, 350–352, 4.8, 243, 244; 264/129, 39

See application file for complete search history.

(56) References Cited

U.S. PATENT DOCUMENTS

| | | | | |
|---|---|---|---|---|
| 4,076,867 | A | 2/1978 | Lewicki, Jr. et al. | |
| 4,091,154 | A * | 5/1978 | Hirai | 428/158 |
| 4,465,728 | A * | 8/1984 | Haigh et al. | 428/156 |
| 4,620,892 | A * | 11/1986 | Dodson et al. | 156/319 |
| 4,769,188 | A * | 9/1988 | Graham et al. | 264/51 |
| 4,844,850 | A * | 7/1989 | Harder | 264/129 |
| 6,063,444 | A | 5/2000 | Dax | |
| 6,312,632 | B1 | 11/2001 | Graf | |
| 6,465,046 | B1 | 10/2002 | Hansson et al. | |
| 6,551,694 | B1 * | 4/2003 | Imamichi et al. | 428/213 |
| 6,565,919 | B1 | 5/2003 | Hansson et al. | |
| 6,685,993 | B1 | 2/2004 | Hansson et al. | |
| 6,764,568 | B1 * | 7/2004 | Sud | 156/245 |
| 2003/0207083 | A1 | 11/2003 | Hansson et al. | |
| 2005/0110174 | A1 * | 5/2005 | Chen | 264/1.34 |

FOREIGN PATENT DOCUMENTS

| | | |
|---|---|---|
| BE | 1009784 | 8/1997 |
| DE | 2438104 | 10/2003 |
| DE | 2607695 | 10/2003 |
| FR | 2680726 | 3/1993 |
| JP | 56-044644 | 4/1981 |

OTHER PUBLICATIONS

English language Abstract of DE 2607695.
English language Abstract of DE 2438104.

* cited by examiner

*Primary Examiner*—Bena Miller
(74) *Attorney, Agent, or Firm*—Greenblum & Bernstein, P.L.C.

(57) ABSTRACT

A process for producing a decoration, in particular a wood decoration, and a relief, corresponding to the decoration, on the top side of a woodbased-material board which is pressed in a press, by means of a pressing plate, with a cover layer made of a synthetic resin, in particular a paper layer impregnated with melamine resin, which has been applied to the top side of the woodbased-material board, the relief being stamped, during the pressing operation, by a female die which interacts with the pressing plate, is distinguished in that the decoration and the relief are introduced simultaneously into the cover layer.

19 Claims, 1 Drawing Sheet

PROCESS FOR PRODUCING A STRUCTURED DECORATION IN A WOODBASED-MATERIAL BOARD

BACKGROUND OF THE INVENTION

1. Field of the Invention

The invention relates to a process for producing a decoration, in particular a wood decoration, and a relief, corresponding to the decoration, at least on the top side of a woodbased-material board which is pressed in a press, by means of a pressing plate, with a cover layer which consists of a synthetic resin and has been applied beforehand to the top side, the relief being stamped, during the pressing operation, by a female die which interacts with the pressing plate.

2. Background Description

Such a process is known for the purpose of coating a wood fiberboard (MDF, HDF, chipboard or the like) in order to give it the appearance of a genuine-wood panel. Such boards are then used for furniture construction or for covering walls, ceilings or floors. The desired decoration (woodgrain, parquet, tiling, etc.) is printed onto a paper web, which is then coated with synthetic resin and rolled up on to a roll or set down in sheets. The printed paper is then subsequently applied to a wood fiberboard, if appropriate covered by a layer of synthetic resin and then pressed in a press, under the action of temperature, with the wood fiberboard, in which case the synthetic-resin layer melts. The top pressing plate of the press is designed as a female die and provided with a relief which corresponds to the decoration. During pressing, depressions are then formed in the synthetic-resin layer, and these reproduce, for example, the surface of a wooden board or the joints of laid tiles, in order to form as natural a surface as possible on the woodbased material board.

As a result of the operations of printing the decoration onto the paper web, or subsequently sealing the paper web with synthetic resin and of then connecting the decorative layer to the wood fiberboard by pressure and temperature, the dimensions of the paper web change. According to the person skilled in the art, the paper grows. The paper grows both in length (increase in length) and in width (increase in width). The paper growth cannot be predetermined and is up to 1%. In the case of a conventional press length of 5.6 m, the paper thus grows by more than 5 cm throughout. The female die, which stamps the relief into the synthetic-resin layer, is designed to correspond to the desired structure of the decoration, and it is not possible to make allowances for the paper growth, since the latter cannot be ascertained. In practice, the relief does not match the decoration, as a result of which it is not possible to imitate a genuine-wood surface. The deviations between the decorative structure and relief for example in the case of a tile pattern, as is used for floor panels, have to be assessed even more critically. If the relief which assists the printed-on joint is stamped alongside the joint, rather than on top of it, this results in a grave loss in quality.

SUMMARY OF THE INVENTION

All attempts to reduce the paper growth in order thus to satisfy the quality of the coated wood fiberboards have had little success to date. Practice has thus turned to reducing the press length, which results, of course, in the production costs increasing.

Taking this problem as the departure point, it is intended to improve the process explained in the introduction such that the decoration and relief also correspond to one another on the finished board.

The problem is solved according to the invention in that the decoration and the relief are introduced simultaneously into the cover layer.

Since the decoration, rather than being printed onto the paper, is now basically printed onto the cover layer, which takes place at the same time as the relief is stamped, the relief and structure of the decoration are completely congruent in relation to one another, with the result that a very high-grade surface appearance is achieved. This high-grade appearance is particularly advantageous if the wood fiberboard is to be used for furniture construction, for interior doors or the like, for example, floors.

In order for the decoration and relief to be introduced simultaneously into the cover layer, the female die is preferably coated with ink before the pressing operation and the decoration is formed by the relief being provided with color.

It is advantageous, in particular, if the ink binds with the synthetic resin during pressing of the cover layer. This then achieves a wiping-resistant surface.

It is advantageous, in particular, if a single-colored paper layer is applied to the board, the cover layer of synthetic resin then being applied to the paper layer. It is also possible, however, for the surface of the top side of the board to be provided with color (painted) or printed before the cover layer is applied.

In order to achieve an unusual appearance, it is also possible for a multi-colored paper layer to be applied to the top side of the board, the cover layer of synthetic resin then being applied to this paper layer.

A board which is produced in accordance with the process and is made of a woodbased material, in particular MDF or HDF, with a surface provided with a decoration and a stamped relief, is distinguished in that decoration is formed by ink introduced into the structure of the relief.

The decoration is preferably a wood decoration.

DETAILED DESCRIPTION OF EMBODIMENTS OF THE INVENTION

Figure 1:
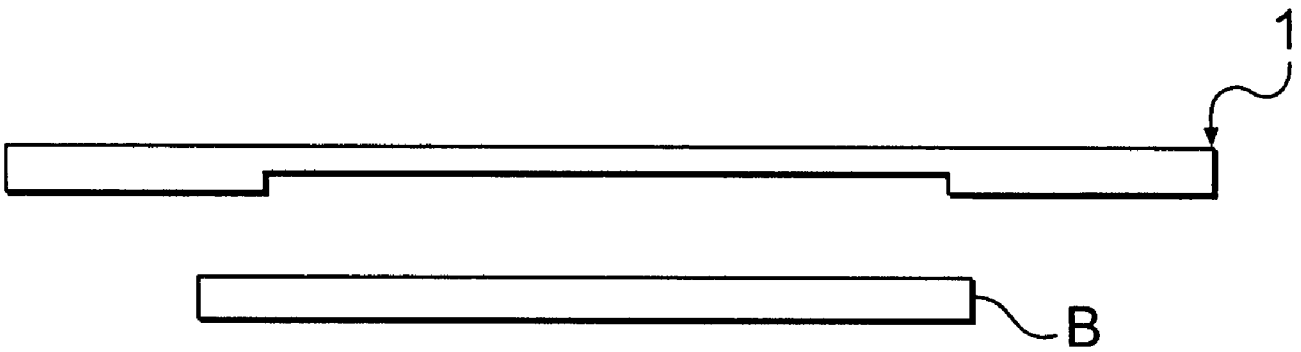
FIG. 1 show an aspect of the invention according to the invention.

Possible woodbased-material boards B, which are used as support boards for surface-finishing purposes, are chipboards, medium density fiberboards (MDF), high density fiberboards (HDF) or Oriented Strand Boards (OSB). These support boards are produced by pressing appropriate wood fibers mixed with synthetic resin. A single-colored or multi-colored paper layer which is impregnated with melamine resin is then applied to this support panel. A further layer made of a synthetic resin may be applied to the paper layer. The board is then passed to a press, where the cover layer is pressed with the board under high pressure and temperature, in which case the resin melts and binds firmly to the top side of the support board.

The top pressing plate 1 of the press is designed as a female die. It has the negative/positive of the relief which is to be stamped into the surface of the board. This relief may be the reproduction of a woodgrain or also of joints of a tiled surface. This relief, which projects beyond the surface of the pressing plate, is coated with a printing ink before the pressing operation. During pressing, the synthetic resin melts, the structure of the relief forms as a depression in the synthetic-resin layer and, at the same time, the ink is transferred into the depressions of the relief and binds with the liquid synthetic resin.

In order to achieve a particular appearance, it is also possible for different colors or inks to be applied to the relief. It is also possible just for individual regions of the female die to be coated with ink. By virtue of the printing ink binding with the synthetic resin, an abrasion-resistant surface is achieved.

The invention claimed is:

1. A process for producing a decoration and a relief, corresponding to the decoration, at least on a top side of a woodbased-material board, the process comprising:

applying a cover layer of a synthetic resin to the top side of the woodbased-material board;

pressing in a press, by means of a pressing plate, the woodbased-material board with the cover layer of a synthetic resin which has previously been applied to the top side of the woodbased-material board, wherein the relief is stamped, during the pressing operation, by a female die which interacts with the pressing plate, and wherein the decoration and the relief are introduced simultaneously into the cover layer.

2. The process according to claim 1, wherein the decoration is a wood decoration.

3. The process according to claim 1, further comprising coating the female die with ink before the pressing operation and producing the decoration by providing the relief with color.

4. The process according to claim 3, wherein the ink binds with the synthetic resin during pressing of the cover layer.

5. The process according to claim 1, further comprising, prior to applying the cover layer, applying a single-colored paper layer to the top side of the woodbased-material board, whereby the cover layer of synthetic resin is applied to the single-colored paper layer.

6. The process according to claim 1, further comprising providing the top side of the woodbased-material board with color before the cover layer is applied.

7. The process according to claim 1, further comprising applying to the relief a layer of ink.

8. The process according to claim 1, further comprising applying a multi-colored paper layer to the top side of the woodbased-material board.

9. The process according to claim 8, wherein the cover layer of synthetic resin is applied to the multi-colored paper layer.

10. A process for producing a decoration and a relief, corresponding to the decoration, at least on a top side of a woodbased-material board, the process comprising:

applying a paper layer which is impregnated with melamine resin to the top side of the woodbased-material board;

pressing in a press, by means of a pressing plate, the woodbased-material board with the paper layer which is impregnated with melamine resin and has been applied beforehand to the top side of the woodbased-material board, wherein the relief is stamped, during the pressing operation, by a female die which interacts with the pressing plate, and wherein the decoration and the relief are introduced simultaneously into the cover layer.

11. The process according to claim 10, wherein the decoration is a wood decoration.

12. The process according to claim 10, further comprising coating the female die with ink before the pressing operation and producing the decoration by providing the relief with color.

13. The process according to claim 10, wherein the paper layer is a single-colored paper layer, and further comprising applying a cover layer of synthetic resin to the single-colored paper layer.

14. The process according to claim 10, further comprising providing the top side of the woodbased-material board with color and thereafter applying a cover layer.

15. The process according to claim 10, wherein the paper layer is a multi-colored colored paper layer.

16. A process for producing a decoration and a relief that corresponds to the decoration at least on a top side of a woodbased-material board, the process comprising:

coating a female die with ink;

applying a paper layer to the top side of the woodbased-material board;

applying a cover layer of synthetic resin to the paper layer; and pressing in a press, using a pressing plate and the female die, the woodbased-material board after being applied with the cover layer and the paper layer, wherein the pressing causes the relief and the decoration to be simultaneously introduced into the cover layer and causes the ink to bind with the synthetic resin.

17. The process of claim 16, wherein the pressing causes melting of the synthetic resin and causes the ink to transfer to into depressions of the relief.

18. A process for producing a decoration and a relief that corresponds to the decoration at least on a top side of a woodbased-material board, the process comprising:

coating a female die with ink;

applying a paper layer impregnated with melamine resin to the top side of the woodbased-material board;

applying a cover layer of synthetic resin to the paper layer; and pressing in a press, using a pressing plate and the female die, the woodbased-material board after being applied with the cover layer and the paper layer, wherein the pressing causes the relief and the decoration to be simultaneously introduced into the cover layer and causes the ink to bind with the synthetic resin.

19. The process of claim 18, wherein the pressing causes melting of the synthetic resin and causes the ink to transfer into depressions of the relief.

* * * * *